US007401864B2

(12) United States Patent
Chang

(10) Patent No.: US 7,401,864 B2
(45) Date of Patent: Jul. 22, 2008

(54) METHOD OF MANUFACTURING A PERSONAL CLEANING UTENSIL

(76) Inventor: Che-Yuan Chang, No. 1, Lane 147, Sec. 2, Chung San Rd., Yun Lin, Chang Hua Hsien (TW)

( * ) Notice: Subject to any disclaimer, the term of this patent is extended or adjusted under 35 U.S.C. 154(b) by 503 days.

(21) Appl. No.: 11/111,889

(22) Filed: Apr. 22, 2005

(65) Prior Publication Data

US 2006/0236486 A1 Oct. 26, 2006

(51) Int. Cl.
*A47K 7/02* (2006.01)

(52) U.S. Cl. ..... 300/21; 15/209.1

(58) Field of Classification Search ..... 15/209.1, 15/229.11; 300/21
See application file for complete search history.

(56) References Cited

U.S. PATENT DOCUMENTS 5,144,744 A 9/1992 Campagnoli
5,946,780 A * 9/1999 Borcherds et al. ..... 28/147
6,443,527 B1 * 9/2002 Borcherds et al. ..... 300/21
6,510,577 B1 * 1/2003 Borcherds et al. ..... 15/118
6,676,222 B2 * 1/2004 Hsu ..... 300/21
6,839,931 B2 * 1/2005 Chen ..... 15/209.1
6,871,375 B2 * 3/2005 Borcherds ..... 15/209.1
2004/0000019 A1 * 1/2004 Chang ..... 15/209.1
2005/0034258 A1 * 2/2005 Huang ..... 15/209.1

FOREIGN PATENT DOCUMENTS

EP 896810 * 2/1999

* cited by examiner

*Primary Examiner*—Mark Spisich
(74) *Attorney, Agent, or Firm*—Bacon & Thomas, PLLC

(57) ABSTRACT

A personal cleaning utensil includes at least one binding member and a plurality of elastic elements which are respectively formed of elastic netting tubes having optionally different meshes or colors and bound together by the binding member.

1 Claim, 8 Drawing Sheets

METHOD OF MANUFACTURING A PERSONAL CLEANING UTENSIL

BACKGROUND OF THE INVENTION

1. Field of the Invention

The present invention relates to a personal body cleaning utensil and more particularly, to a bath sponge, which is optionally made of different materials in different colors, and to a method of manufacturing the bath sponge.

2. Description of the Related Art

U.S. Pat. No. 5,144,744 discloses a manufacturing method of a diamond-mesh polyethylene netting sponge. According to this method, a diamond-mesh polyethylene netting sponge is obtained from a number of netting tubes stretched over supports, joined and bound together at the center and the released from the supports. According to the characteristics of the netting sponge as stated in the specification of the aforesaid prior art patent, the netting sponge is very easy to clean, and short rinsing is sufficient to eliminate all trace of dirt, and the sponge then dries rapidly.

However, because the netting tubes of the netting sponge of the aforesaid prior art design are made from one single material, i.e., polyethylene, the netting sponge provides only one roughness. It is neither practical nor comfortable to use a bath sponge having a particular roughness for cleaning different parts of the body. Therefore, a person may have to prepare several bath sponges having different roughness for cleaning different parts of the body.

SUMMARY OF THE INVENTION

The present invention has been accomplished under the circumstances in view. It is the main object of the present invention to provide a personal cleaning utensil, which is prepared from multiple materials in optionally different colors for different applications.

It is another object of the present invention to provide a personal cleaning utensil that causes a sense of beauty.

To achieve these objects of the present invention, the personal cleaning utensil comprises at least one binding member and a plurality of elastic elements formed of elastic netting tubes having optionally different meshes or colors and bound together by the binding member.

DETAILED DESCRIPTION OF THE INVENTION

Figure 1:
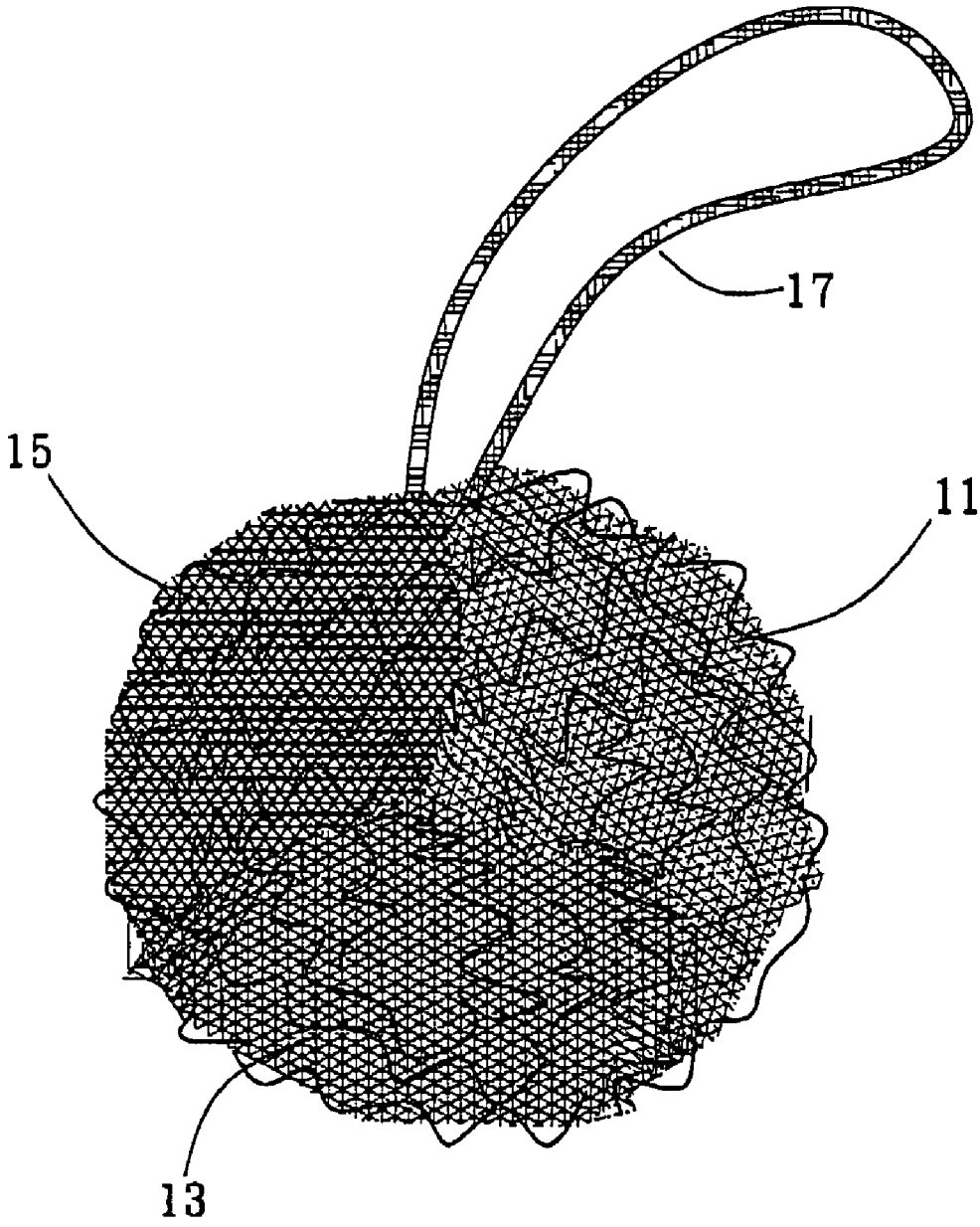
FIG. 1 is a schematic drawing showing a personal cleaning utensil according to the present invention.
Figure 2:
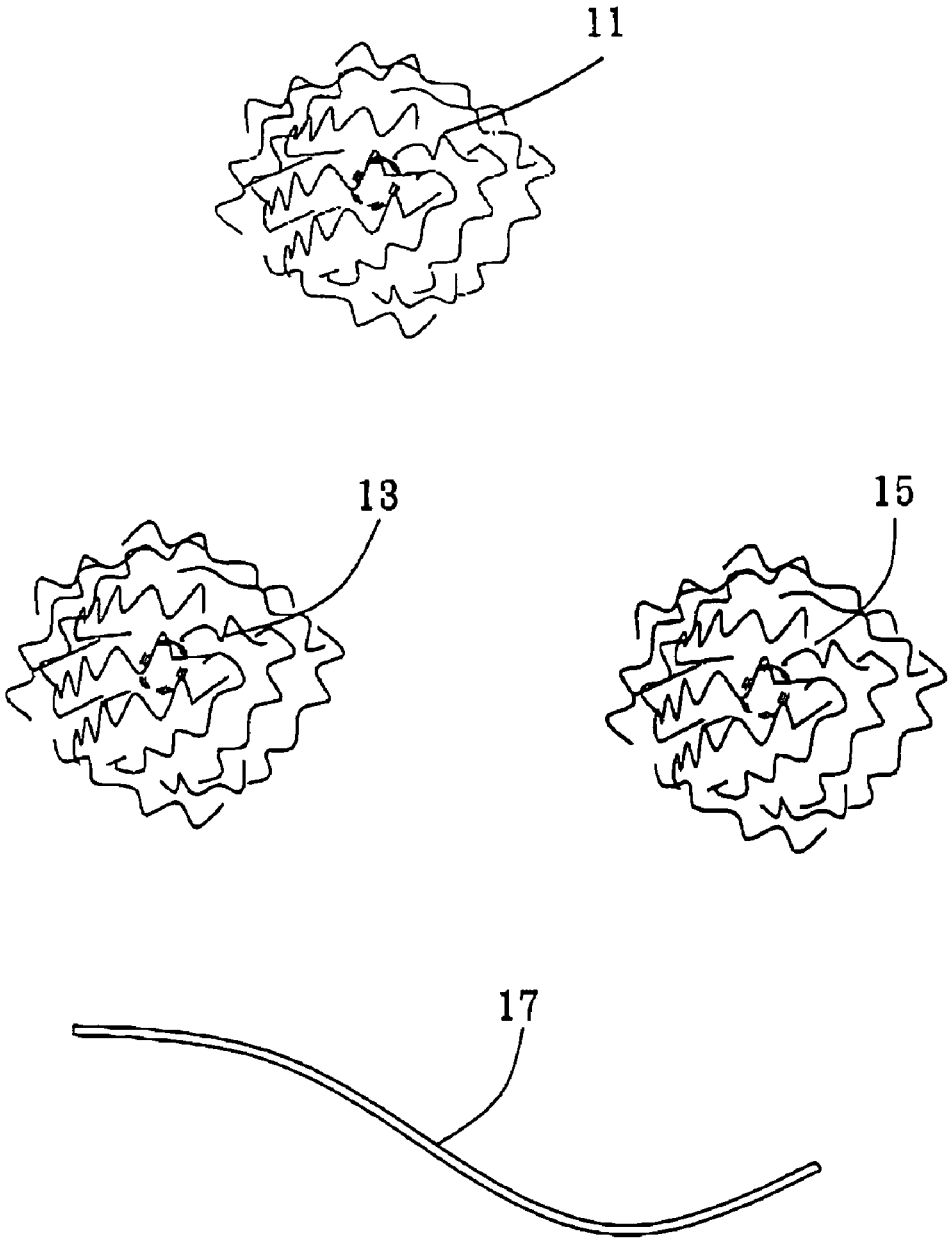
FIG. 2 is an exploded view of the personal cleaning utensil according to the present invention.

Referring to FIGS. 1 and 2, a personal cleaning utensil in accordance with the present invention is shown comprised of a first element 11, a second element 13, a third element 15, and a binding strip 17. The first, second and third elements 11, 13, and 15 are respectively obtained from elastic netting tubes having optionally different meshes or colors. The binding strip 17 binds the first, second and third elements 11, 13, and 15 together. The elasticity of the elastic netting tubes of the elements 11, 13, and 15 has the personal cleaning utensil always maintained its original bulky spherical volume.

Figure 3:
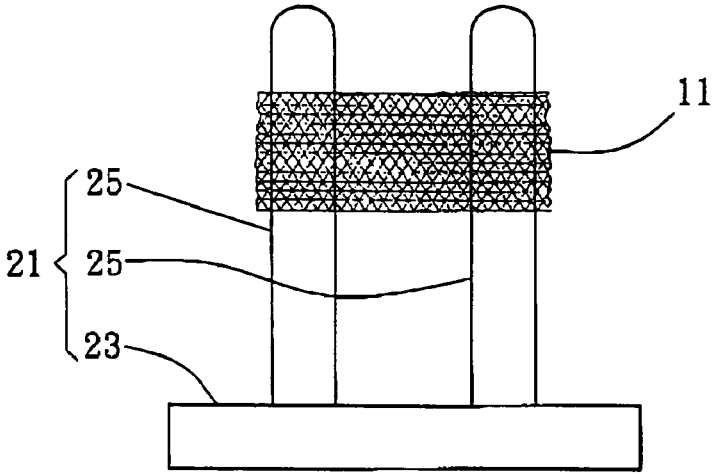
FIG. 3 is a schematic drawing showing a stage of manufacture of a personal cleaning utensil according to the present invention, where a first element is stretched over two parallel uprights of a support structure.
Figure 4:
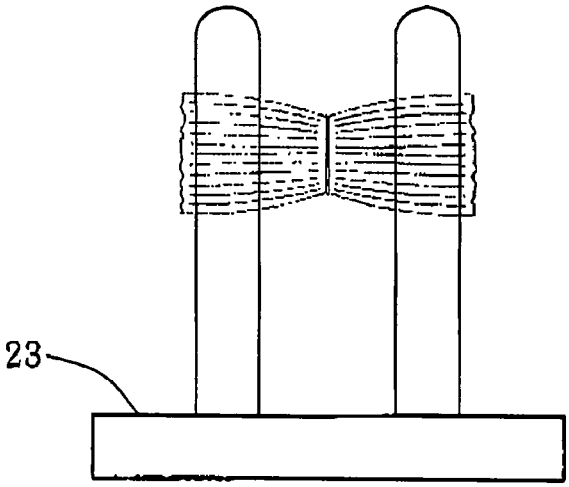
FIG. 4 is a schematic drawing showing a stage of manufacture of a personal cleaning utensil according to the present invention, where the stretched first element is tied with a first binding strip near the center area.
Figure 5:
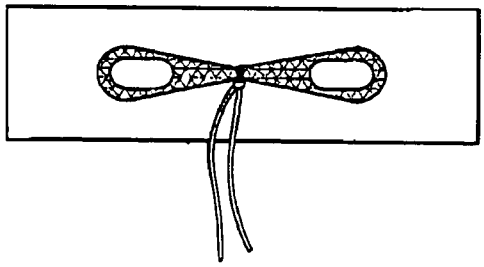
FIG. 5 is a top view of FIG. 4.
Figure 6:
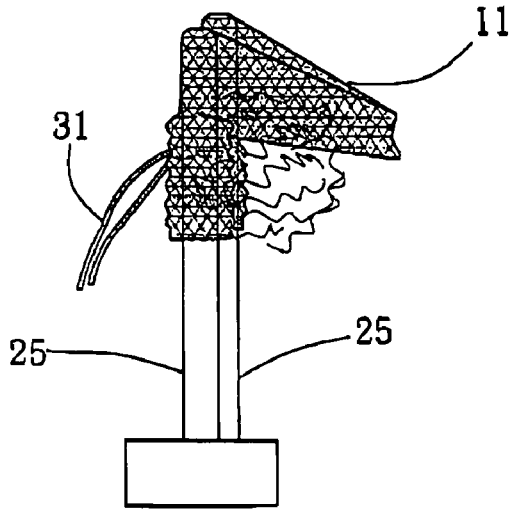
FIG. 6 is a schematic drawing showing a stage of manufacture of a personal cleaning utensil according to the present invention, where the stretched first element is moved upwards from the two parallel uprights of the support structure.
Figure 7:
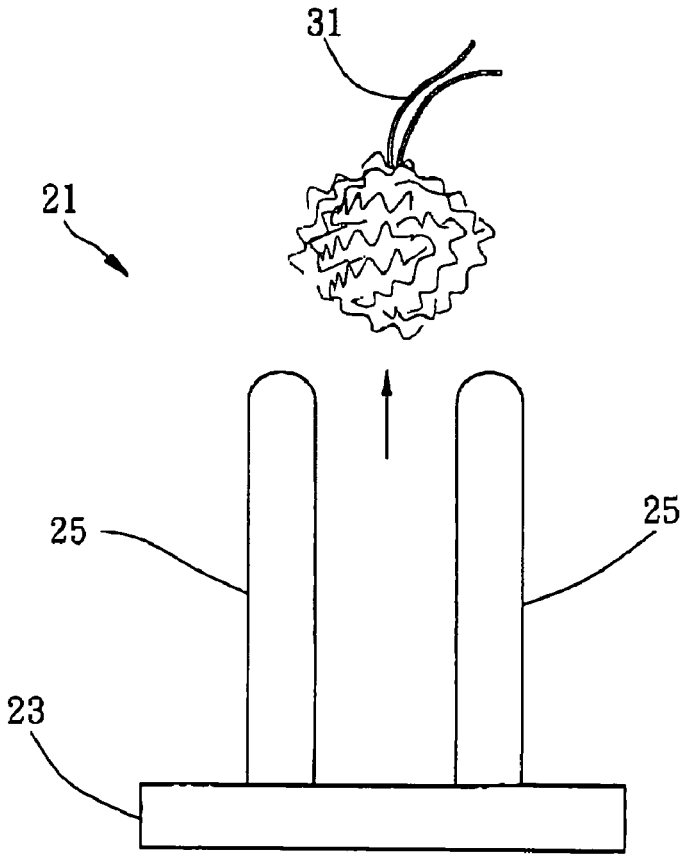
FIG. 7 corresponds to FIG. 6, showing the first element released from the support structure.
Figure 8:
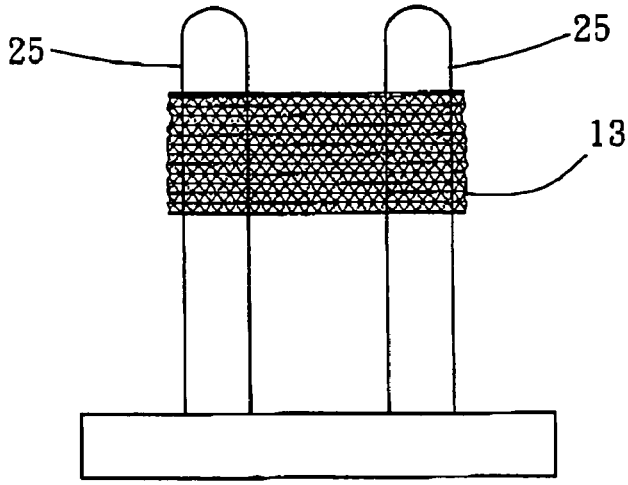
FIG. 8 is a schematic drawing showing a stage of manufacture of a personal cleaning utensil according to the present invention, where a second element is stretched over the two parallel uprights of the support structure.
Figure 9:
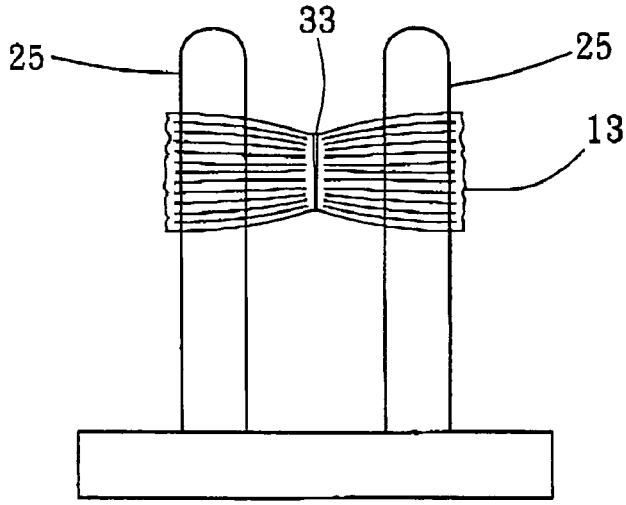
FIG. 9 corresponds to FIG. 8, showing the center area of the stretched second element tied up with a second binding strip.
Figure 10:
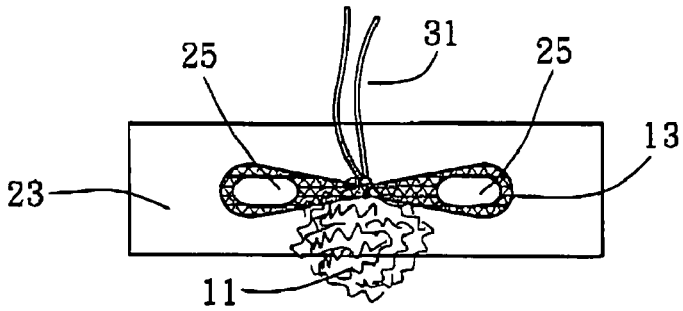
FIG. 10 is a top view corresponding to FIG. 9, showing the first element fastened to the stretched second element at the support structure.
Figure 11:
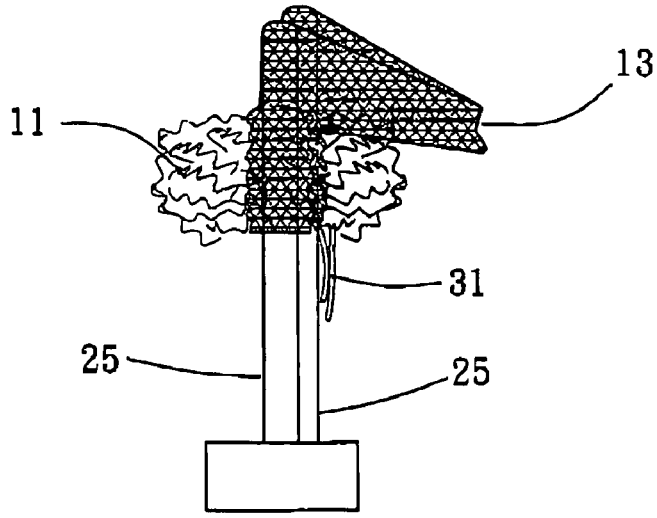
FIG. 11 is a schematic drawing showing a stage of manufacture of a personal cleaning utensil according to the present invention, where the stretched second element is moved upwards from the two parallel uprights of the support structure.
Figure 12:
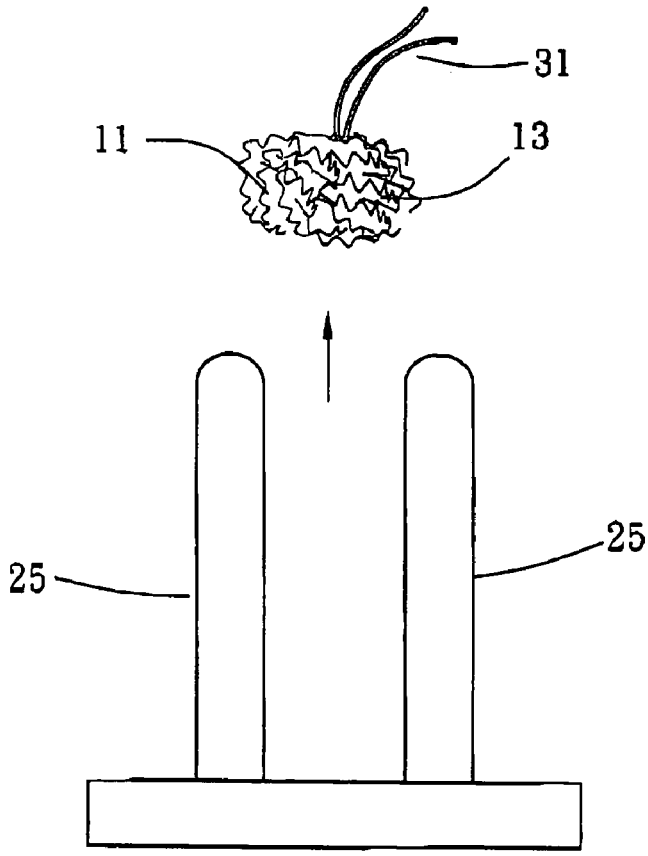
FIG. 12 corresponds to FIG. 11, showing the second element released from the support structure.
Figure 13:
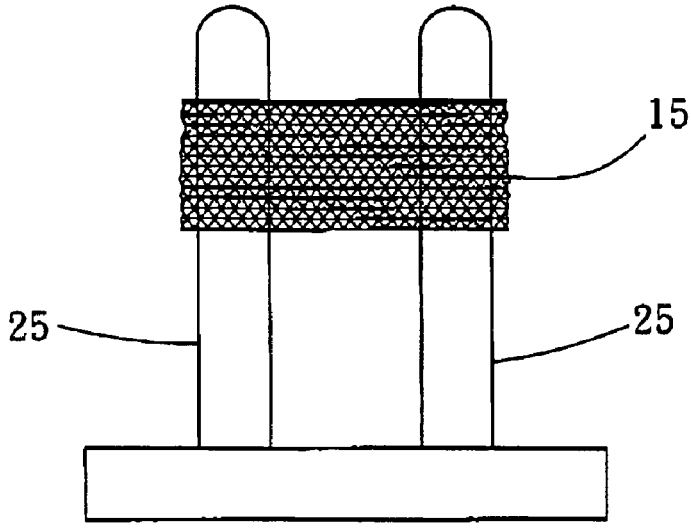
FIG. 13 is a schematic drawing showing a stage of manufacture of a personal cleaning utensil according to the present invention, where a third element is stretched over the two parallel uprights of the support structure.
Figure 14:
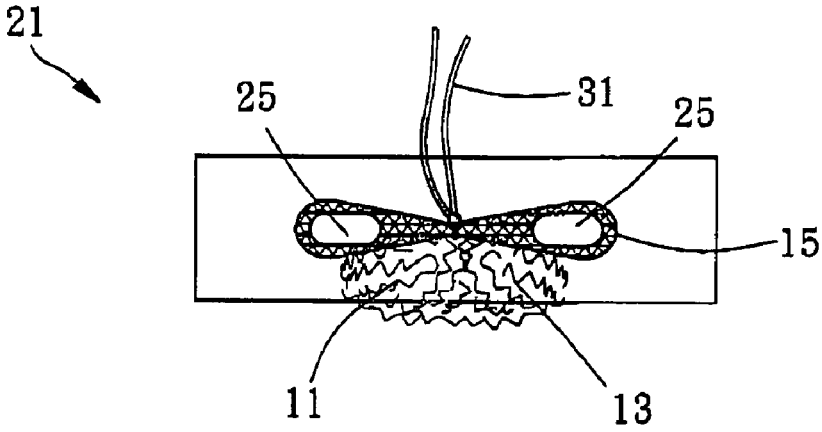
FIG. 14 is a schematic drawing showing a stage of manufacture of a personal cleaning utensil according to the present invention, where the binding strip of the first element fastened to the center area of the stretched third element at the support structure.
Figure 15:
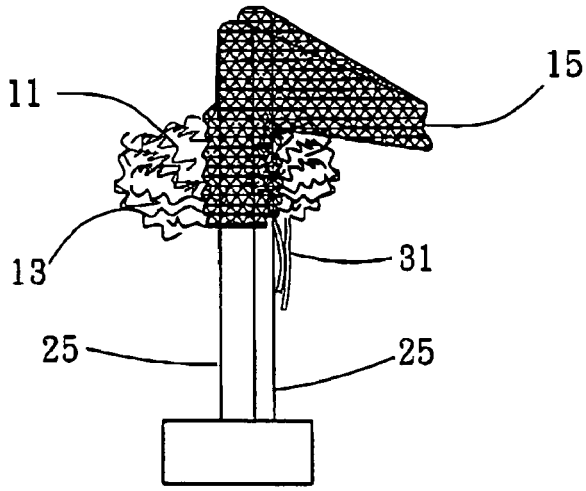
FIG. 15 corresponds to FIG. 14, showing the stretched third element moved upwards from the two parallel uprights of the support structure.
Figure 16:
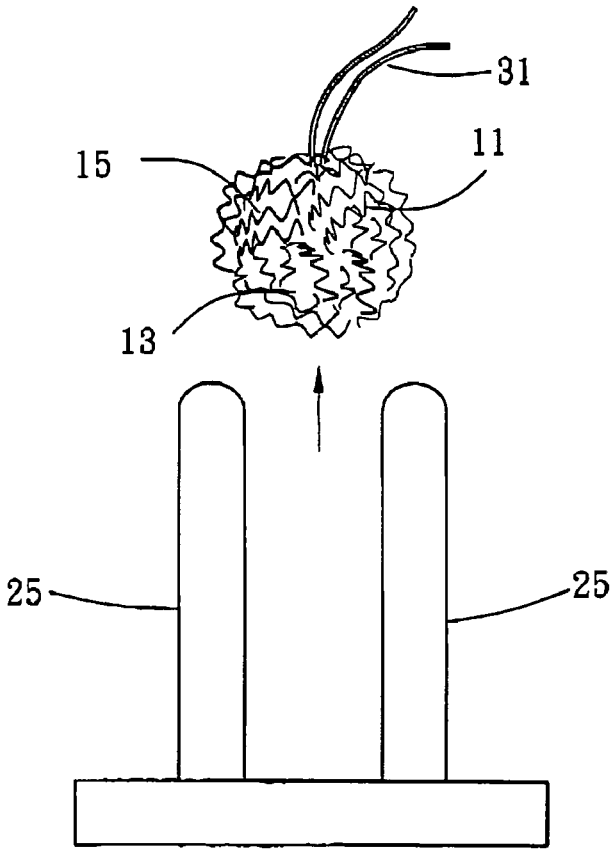
FIG. 16 corresponds to FIG. 15, showing the third element released from the support structure.

The method of manufacturing a personal cleamng utensil accorcung to tne present invention comprises:

Step I: providing a first element 11, a second element 13 and a third element 15, which are elastic netting tubes having different meshes and colors;

Step II: stretching the first element 11 over two parallel uprights 25 above a horizontal base 23 of a support structure 21, enabling the parallel uprights 25 to keep the first element 11 taut and stretched in a direction transverse to the longitudinal axis of the first element 11 (see FIG. 3);

Step III: binding the stretched first element 11 with a first binding strip 31 near the center area of the stretched first element 11, keeping the two distal ends of the stretched first element 11 free (see FIGS. 4 and 5);

Step IV: releasing the stretched first element 11 from the support structure 21, whereby the first element 11 through its resiliency rebound into a rounded sponge shape around the first binding strip 31 (see FIGS. 6 and 7);

Step V: stretching the second element 13 over the two parallel uprights 25 of the support structure 21, enabling the parallel uprights 25 to keep the second element 13 taut and stretched in a direction transverse to the longitudinal axis of the second element 13 (see FIG. 8);

Step VI: binding the stretched second element 13 with a second binding strip 33 near the center area of the stretched second element 13 (see FIG. 9);

Step VII: tying the first element 11 that is maintained in a rounded sponge shape to the center area of the stretched second element 13 with the first binding strip 31, keeping the two distal ends of the first binding strip 31 free (see FIG. 10);

Step VIII: releasing the stretched second element 13 from the support structure 21, whereby the second element 13 through its resiliency rebound into a rounded sponge shape around the second binding strip 33 (see FIGS. 11 and 12);

Step IX: stretching the third element 15 over the two parallel uprights 25 of the support structure 21, enabling the parallel uprights 25 to keep the third element 15 taut and stretched in a direction transverse to the longitudinal axis of the third element 15 (see FIG. 13);

Step X: tying the first element 11 that is maintained in a rounded sponge shape and fastened to the second element 13 to the center area of the stretched third element 15 with the first binding strip 31, keeping the first element 11, the second element 13 and the third element 15 bound together (see FIG. 14); and Step XI: releasing the stretched third element 15 from the support structure 21, whereby the third element 15 through its resiliency rebound into a rounded sponge shape around the first binding strip 31 (see FIGS. 15 and 16).

Because the first, second and third elements 11, 13, and 15 are prepared from netting tubes having different meshes, the personal cleaning utensil thus obtained has three different roughness for cleaning different parts of the body. For example, the user can use the first element of the personal cleaning utensil that has relatively smaller meshes to clean a sensitive part of the body. Further, the three elements of the personal cleaning utensil can be prepared in different colors, thereby the personal cleaning utensil causes a sense of color beauty.

What is claimed is:

1. A method of manufacturing a personal cleaning utensil, comprising the steps of:

a) providing a first element and a second element, which are resilient netting tubes respectively;

b) stretching said first element in a direction transverse to a longitudinal axis thereof;

c) tying up a center area of the stretched first element with a binding member;

d) releasing said first element from the stretched condition;

e) stretching said second element in a direction transverse to a longitudinal axis thereof;

f) binding said first element to said second element by tying said binding member to a center area of the stretched second element; and g) releasing said second element from the stretched condition.

* * * * *